US005934028A

United States Patent [19]

Taylor

[11] Patent Number: 5,934,028

[45] Date of Patent: Aug. 10, 1999

[54] TOGGLE LINKAGE SEISMIC ISOLATION STRUCTURE

[75] Inventor: Douglas P. Taylor, N. Tonawanda, N.Y.

[73] Assignee: Tayco Developments, Inc., North Tonawanda, N.Y.

[21] Appl. No.: 08/975,129

[22] Filed: Nov. 20, 1997

Related U.S. Application Data

[63] Continuation-in-part of application No. 08/694,153, Aug. 8, 1996, Pat. No. 5,870,863.

[51] Int. Cl.[6] ..... E04H 9/02

[52] U.S. Cl. ..... 52/167.3; 52/167.1; 52/167.4; 52/646; 248/632; 248/638; 403/119; 403/171

[58] Field of Search ..... 52/167.1, 167.2, 52/167.3, 646; 248/632, 638; 403/119, 161, 171

[56] References Cited

U.S. PATENT DOCUMENTS

| | | | |
|---|---|---|---|
| 1,388,162 | 8/1921 | Schwemlein | 403/171 X |
| 3,418,768 | 12/1968 | Cardan | 52/167 |
| 4,064,977 | 12/1977 | Taylor | 188/317 |
| 4,582,303 | 4/1986 | Taylor | 188/322 |
| 4,638,895 | 1/1987 | Taylor et al. | 188/280 |
| 4,815,574 | 3/1989 | Taylor et al. | 133/280 |
| 4,867,286 | 9/1989 | Taylor | 188/282 |
| 4,910,929 | 3/1990 | Scholl | 52/167 |
| 4,922,667 | 5/1990 | Kobori et al. | 52/167 |
| 5,224,320 | 7/1993 | Mai | 52/648.1 |
| 5,271,197 | 12/1993 | Uno et al. | 52/167 |
| 5,386,671 | 2/1995 | Hu et al. | 52/167.3 |
| 5,462,141 | 10/1995 | Taylor | 188/280 |

FOREIGN PATENT DOCUMENTS

| | | | |
|---|---|---|---|
| 1-284639 | 11/1989 | Japan . | |
| 2-209570 | 8/1990 | Japan | 52/167 CB |
| 3-235856 | 10/1991 | Japan | 52/167 CB |

*Primary Examiner*—Carl D. Friedman
*Assistant Examiner*—Winnie S. Yip
*Attorney, Agent, or Firm*—Joseph P. Gastel

[57] ABSTRACT

A toggle linkage for incorporation into a frame of a structure, such as a building, including a first link having a shock absorber therein, a first end on the first link connected to a first area of the frame, a second link having a first end connected to a second area of the frame remote from the first area, a second end on the second link, a third link having a first end connected to a third area on the frame remote from the first and second areas, and a second end on the third link. The second ends of the second and third links are connected to each other by a metal plate structure which has a bending axis, and the second end of the first link is pivotally connected to the second ends of the second and third links along an axis which is coincident with the bending axis of the metal plate structure.

29 Claims, 6 Drawing Sheets

TOGGLE LINKAGE SEISMIC ISOLATION STRUCTURE

CROSS-REFERENCE TO RELATED APPLICATIONS

The present application is a continuation-in-part of application Ser. No. 08/694,153, filed Aug. 8, 1996, now U.S. Pat. No. 5,870,863.

STATEMENT REGARDING FEDERALLY SPONSORED RESEARCH OR DEVELOPMENT

Not Applicable

BACKGROUND OF THE INVENTION

The present invention relates to an improved seismic isolation structure utilizing a toggle linkage.

By way of background, there are in use two common types of seismic isolation devices utilizing viscous dampers. One type is a diagonal brace structure incorporating a viscous damper, which is placed in a frame of a structure, such as a building. Another type of device is a chevron structure which is placed in the frame of a building. The seismic displacement which is opposed by the foregoing seismic isolation devices is the horizontal displacement between the floors of a building or between various levels of other structures, such as bridges, and it is this displacement which must be used to drive the viscous damper. However, in diagonal and chevron isolation devices, the damper has a very small displacement as the various levels of a structure move relative to each other, thereby requiring large, heavy, short stroke dampers which are relatively expensive both in initial cost of fabrication and cost of installation. By way of broad example, the relative movement between floors of a building could be on the order of a fraction of an inch. Thus, for example, in a rectangular frame of a building wall having a dimension of about 22 feet horizontally and 20 feet vertically and having a diagonal of about 30 feet, the change in length of the diagonal would be only a fraction of an inch. This small fraction of an inch in change in length of a diagonal constitutes the stroke which has to be applied to the viscous damper, thereby necessitating the above-mentioned relatively large, heavy, short stroke dampers. Another type of seismic isolation device which is known in the prior art is a toggle linkage such as shown in opened Japanese patent application Sho 63-114069 (Patent No. 1-284639). The advantage of a toggle linkage is that it essentially magnifies relatively small movements between levels of a structure, that is, it provides a motion which is larger than the motion produced by the change in length of a diagonal brace or by the movement of a chevron brace. Thus, a toggle brace permits the use of relatively inexpensive long stroke, relatively light hydraulic dampers and also permits the use of other types of long stroke shock absorbers. However, toggle linkages with clevis types of connections at the junctions of the links of a toggle linkage have certain deficiencies, namely, (1) there is too much play at the clevis so that the shifting of the floors of a building is not fully transmitted by the links of the toggle linkage to the damper, and (2) the clevis connection inherently permits out-of-plane buckling which further diminishes the amount of floor shifting which is effectively transmitted to the toggle linkage.

In copending application Ser. No. 08/694,153, filed Aug. 8, 1996, a solid joint in the form of a metal plate replaced a clevis joint between the inner ends of a toggle linkage to eliminate play at the clevis and also eliminate out-of-plane buckling of the toggle linkage. However, it was discovered that, in cases where the metal plate was made relatively thin, the metal plate did not bend accurately along a desired pivot axis between the two links which it connected. More specifically, instead of bending about a desired well defined axis, it bent in a complex undulating shape which, in turn, caused the stroke of the damper to be shortened. It is believed that this was due to the fact that the link which contained the damper was secured to one of the toggle links, and thus there was an unequal force distribution on the links which were connected to each other by the metal plate due to the fact that the force of the damper was applied onto only one of the links when a seismic shock was experienced. It is with overcoming the foregoing deficiency of a toggle linkage having a prior type of plate connection that the present invention is concerned.

BRIEF SUMMARY OF THE INVENTION

It is the object of the present invention to provide an improved seismic isolation device utilizing a damper and toggle linkage having a plate-type of connection at the junction of the links so that the plate is caused to bend about a predetermined well-defined bending axis, thereby insuring that the stroke of the damper associated with the toggle linkage will not be shortened. Other objects and attendant advantages of the present invention will readily be perceived hereafter.

The present invention relates to a seismic isolator for placement in a frame of a structure comprising a first link having a shock absorbing member therein, a first end on said first link for connection to a first area on said frame, a second end on said first link, a second link having a first end for connection to a second area on said frame remote from said first area, a second end on said second link, a third link having a first end for connection to a third area on said frame remote from said first and second areas, a second end on said third link, means providing a solid joint connecting said second ends of said second and third links to each other, a bending axis on said means providing a solid joint, and a connection at said second end of said first link and between said second and third links which is substantially coincident with said bending axis.

The present invention will be more fully understood when the following portions of the specification are read in conjunction with the accompanying drawings wherein:

DETAILED DESCRIPTION OF THE INVENTION

Figure 1:
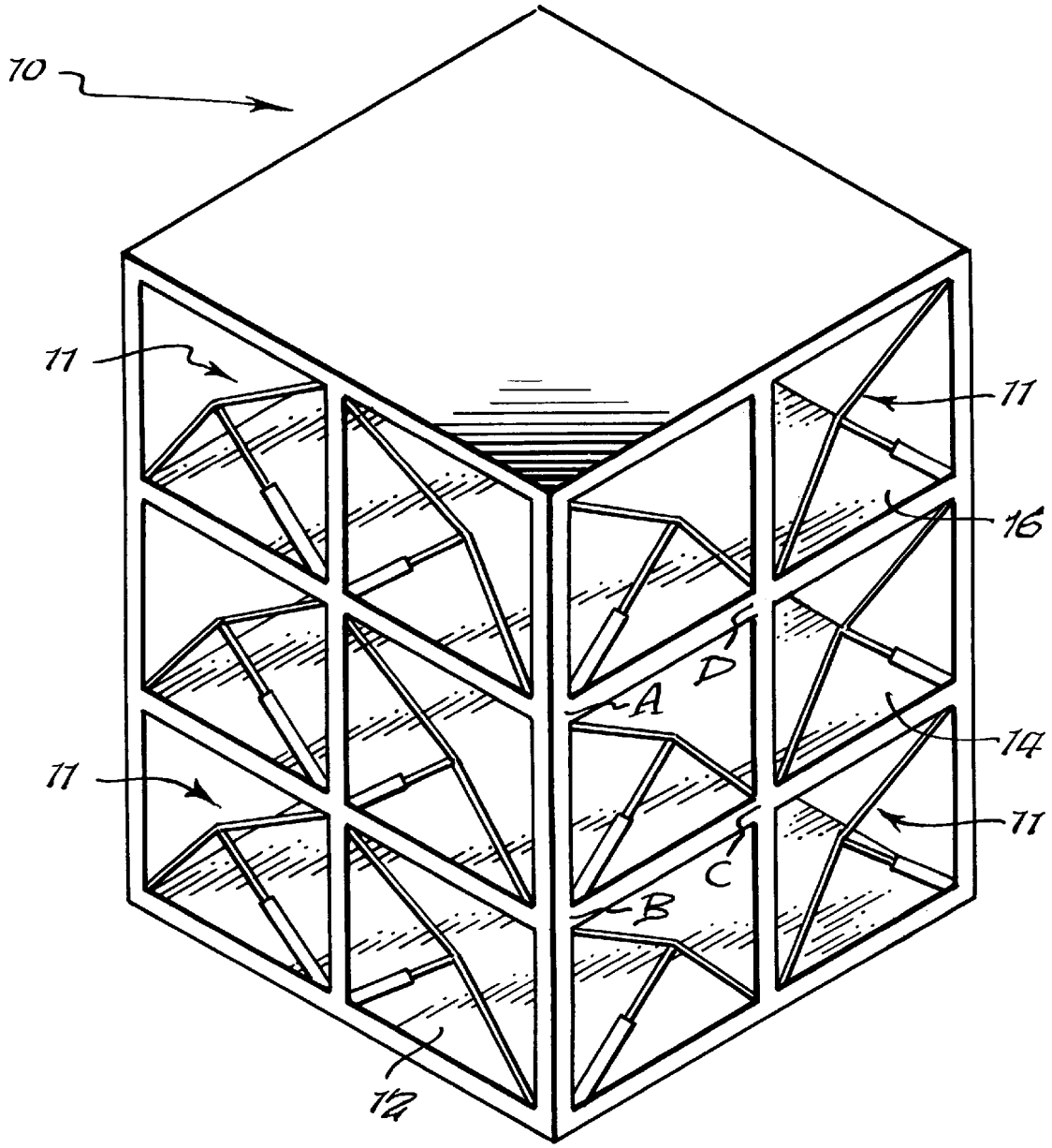
FIG. 1 is a schematic perspective view of an earlier form of a toggle linkage utilizing a plate connection installed in a building.

In FIG. 1 a building frame 10 is schematically shown having a plurality of toggle linkage seismic braces 11 in its framework with each toggle linkage 11 being located within a rectangular frame having four sides, such as AB, BC, CD and AD, and the building 10 having three floors 12, 14 and 16. As is well known, when building 10 is subjected to a seismic shock, the floors 12, 14 and 16 will shift relative to each other in a horizontal direction. Thus, the rectangular frames, such as ABCD, will slightly distort into parallelogram configurations.

Figure 2:
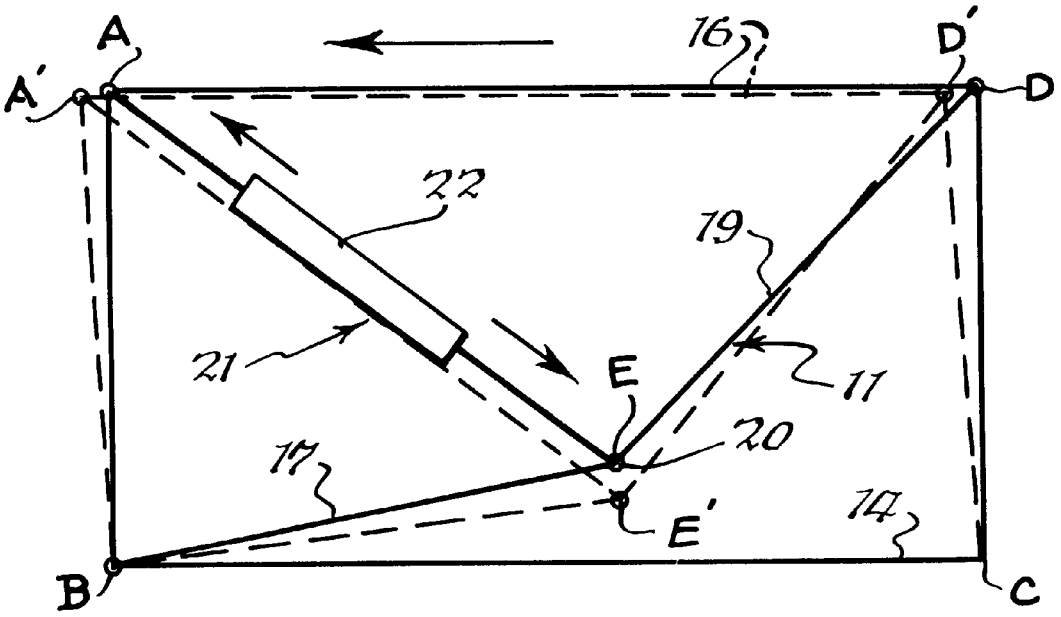
FIG. 2 is a schematic view of the action of the toggle linkage which causes the shock absorber to operate in tension.
Figure 3:
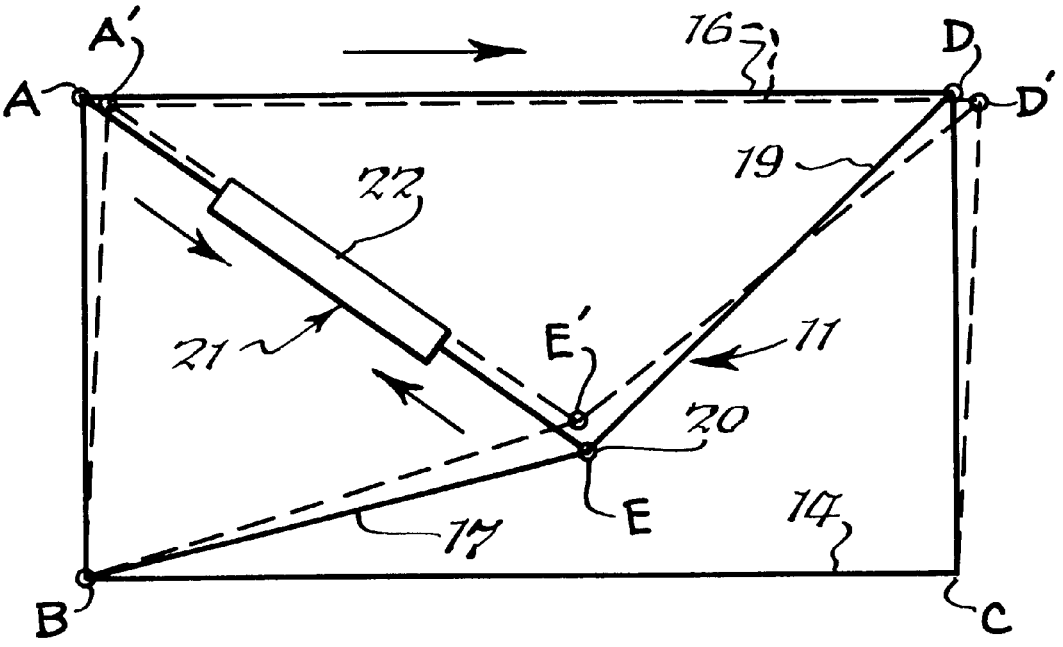
FIG. 3 is a schematic view of the action of the toggle linkage which causes the shock absorber to operate in compression.

In FIGS. 2 and 3 the frame portion ABCD of FIG. 1 is schematically shown by itself. FIG. 2 shows floor 16 shifted to the left relative to floor 14, and FIG. 3 shows floor 16 shifted to the right relative to floor 14. Thus, in FIG. 2 when floor 16 shifts to the left, the corner A of frame ABCD will move to the left to the point A', and corner D will move to the point D' so that rectangle ABCD now becomes parallelogram A'BCD'. In FIG. 3 floor 16 is shown as shifting to the right relative to floor 14 by an amount equal to DD'. Therefore, the rectangle ABCD now becomes parallelogram A'BCD'.

As noted above toggle linkage seismic isolation brace structures are utilized to permit the use of relatively low force, long stroke dampers or shock absorbers with the attendant advantage of lower cost. In FIGS. 2 and 3 a toggle brace structure is disclosed wherein the building frame ABCD is reinforced by a toggle brace linkage which includes links BE and DE and a link AE having a suitable shock absorber such as a liquid damper, liquid spring or combination thereof 22 therein, or any other suitable type of shock absorber, as discussed hereafter.

By way of example, in frame ABCD sides AD and BC are 264 inches long, and sides AB and CD are 240 inches long. Link BE is 178.71 inches long and link DE is 178.32 inches long. When frame ABCD is a rectangle, that is, before it is deflected, link AE is 184.99 inches long. Furthermore, it is preferable that the shock absorber 22 should have a liquid spring characteristic so that it places links BE and DE in tension.

When there is a seismic shock which causes floor 16 to shift to the left in FIG. 2 by an amount of 0.3 inches, so that the corner A moves to point A' and corner D moves to point D', link AE will elongate from 184.99 inches to 187.61 inches, that is, by an amount of 2.62 inches because links BE and DE will move to positions BE' and DE', respectively. Thus when link AE is elongated, the shock absorber 22 will tend to counter this elongation and it can be seen that the stroke is 2.62 inches.

When floor 16 shifts to the right relative to floor 14, as shown in FIG. 3, corner A will move to point A' and corner D will move to point D'. At this time link BE will move to position BE' and link DE will move to position D'E'. The foregoing being the case, link AE will become shortened to link A'E' which has a length of 180.29 inches from the original length of AE of 184.99 inches. Thus, the difference in length between link AE and link A'E' is 4.70 inches. Thus when link AE is elongated, the shock absorber 22 will tend to counter this elongation and it can be seen that the stroke is 4.70 inches.

In accordance with one aspect of an earlier form of the present invention, a solid joint 20 (FIG. 4) is provided between links 17 and 19 of the toggle linkage 11 which also includes link 21 in which shock absorber 22 is located. Links 17 and 19, which correspond to links BE and DE, respectively, of FIGS. 2 and 3, are hollow cylindrical metal members having longitudinal axes 17' and 19', respectively, which lie in a plane when the toggle linkage is not subjected to a seismic event.

Figure 4:
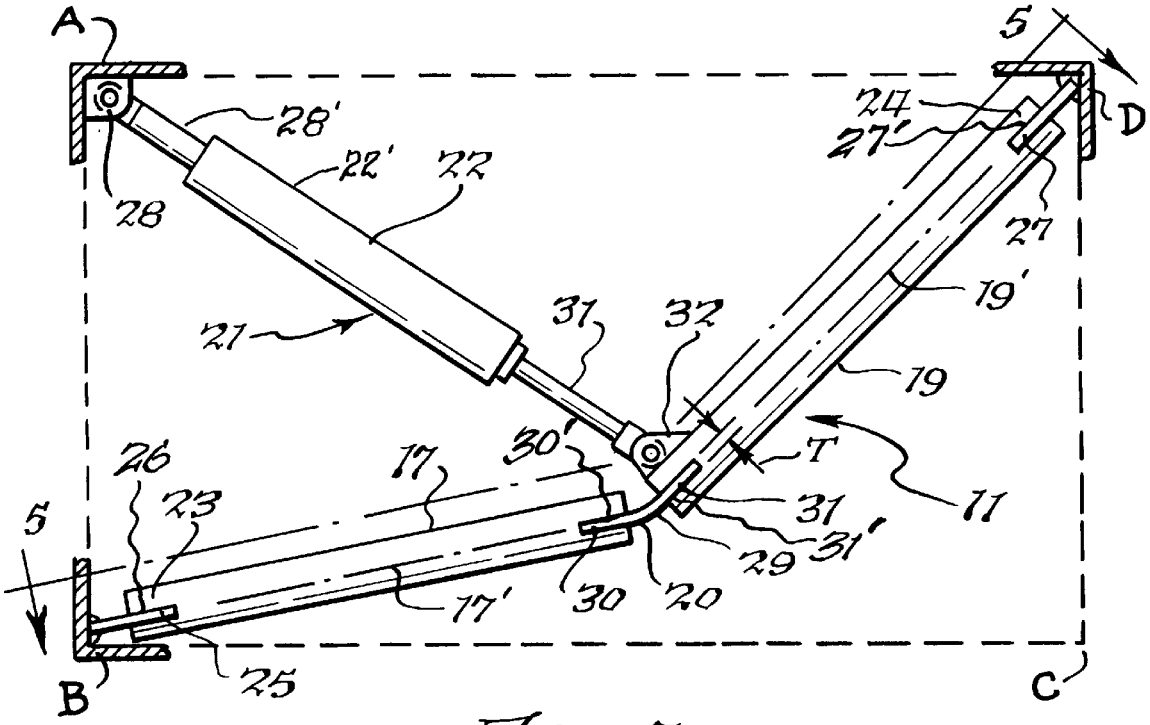
FIG. 4 is a view, partially in cross section, of an earlier form of a toggle linkage in a frame of a building and having a solid joint between certain links and solid joints between these links and the building.
Figure 5:
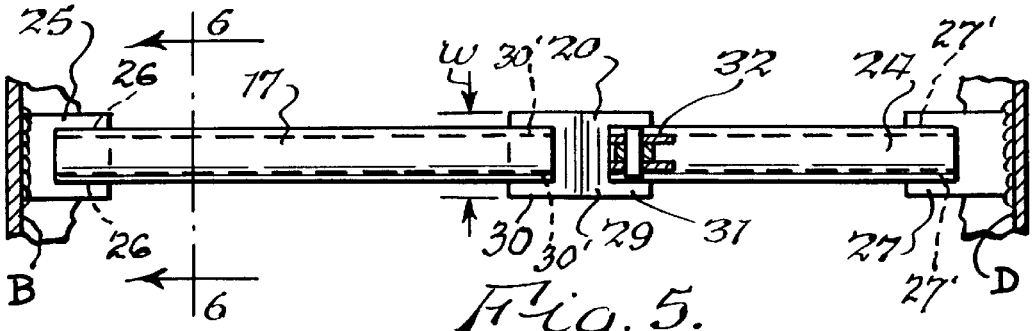
FIG. 5 is a fragmentary view, partially in cross section, taken substantially along line 5—5 of FIG. 4.

The solid joint 20 between links 17 and 19 is a high strength steel plate 29 acting as a single plane to provide a blade-type flexure. Plate 29 has its ends 30 and 31 welded into slots 30' and 31', respectively, in the ends of links 17 and 19, respectively. Plate 29 has a thickness dimension T (FIG. 4) and a width dimension W (FIG. 5). When the frame ABCD distorts to a parallelogram, as shown in FIGS. 2 and 3, plate 29 will flex in the direction of its thickness T. However, plate 29 will not flex in the direction of its width W because of the relatively larger bending moment of inertia of this width dimension, and accordingly there will be no movement of the longitudinal axes 17' and 19' of links 17 and 19, respectively, out of the original plane which they occupied before a seismic event. In other words, there is no out-of-plane buckling of links 17 and 19.

In accordance with another aspect of an earlier form of the present invention, the outer ends 23 and 24 of links 17 and 19, respectively, are rigidly connected to the corners of frame ABCD by solid joints in the following manner. A plate 25 is welded into slots 26 in link end 23, and plate 25 is in turn welded to frame corner B. A plate 27 is welded into slots 27' in link end 24, and plate 27 is in turn welded to frame corner D. Thus there are solid joints between the ends of links 17 and 19 and the frame of the building. The solid joints of this type are perfectly satisfactory because of the very small amounts of angular movement between the building frame and links 17 and 19 during a seismic event. The foregoing solid joints avoid any lost motion between the building frame and links 17 and 19 during a seismic event. Also the plates 25 and 27 of the solid joints at B and D resist out-of-plane buckling of links 17 and 19 for the same reason set forth above relative to plate 29, namely, the larger bending moment of inertia of these plates in their width directions. In other words, all motion of the frame ABCD is transmitted to the links 17 and 19 of the toggle linkage 11, considering that there is no loss of motion therebetween.

Link 21 includes a hydraulic shock absorber 22 wherein the cylinder 22' has one end rigidly connected to rod 28' and the other end of rod 28' is pivotally connected at frame corner A at 28 by means of a clevis joint 30. The piston 31 of shock absorber 22 is pivotally connected to link 19 proximate joint 20 by a clevis joint 32. These clevis joints will not produce any significant lost motion, considering that the forces are transmitted substantially in the direction of the axis of link 21. The shock absorber 22 can be a fluid damper, or a liquid spring, or combinations of both or other types of shock absorbers, as discussed hereafter. Preferably, however, the shock absorber 21 should be a liquid spring so that it will place the toggle links 17 and 19 in tension, although this is not necessary. It will be appreciated that when the foregoing links are placed in tension, the link 21 in which the liquid spring is located will be in compression.

Thus the combination of no loss of motion between links 17 and 19 at solid joint 20 and at the solid joints provided by plates 25 and 27 at the frame corners B and D along with the absence of out-of-plane buckling at joint 20 and at frame corners B and D results in the transmission of the totality of movement of the deflection of frame ABCD during a seismic event to link 21 in which shock absorber 22 is located.

Figure 6:
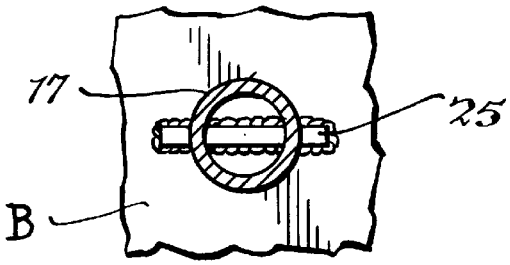
FIG. 6 is a fragmentary cross sectional view taken substantially along line 6—6 of FIG. 5 and showing the solid connection between one end of the toggle linkage and the building frame.
Figure 7:
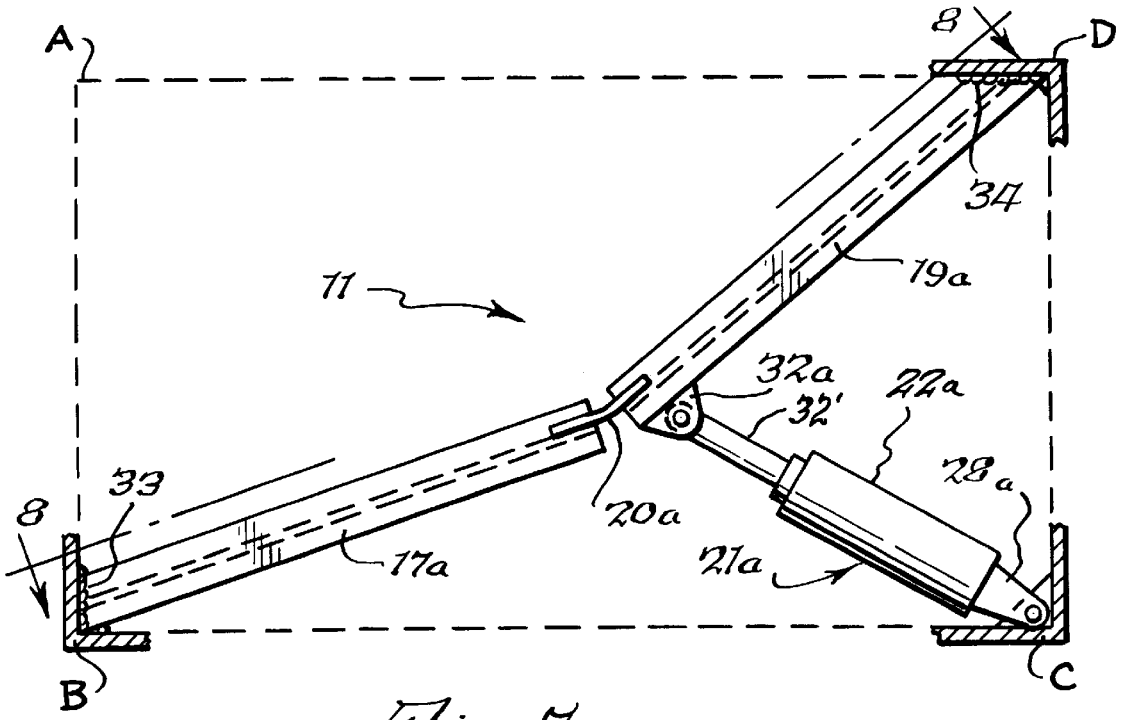
FIG. 7 is a view, partially in cross section, of a modified form of the toggle linkage utilizing I-beams and having an earlier form of a solid connection between certain links and solid connections between these links and the building frame.
Figure 8:
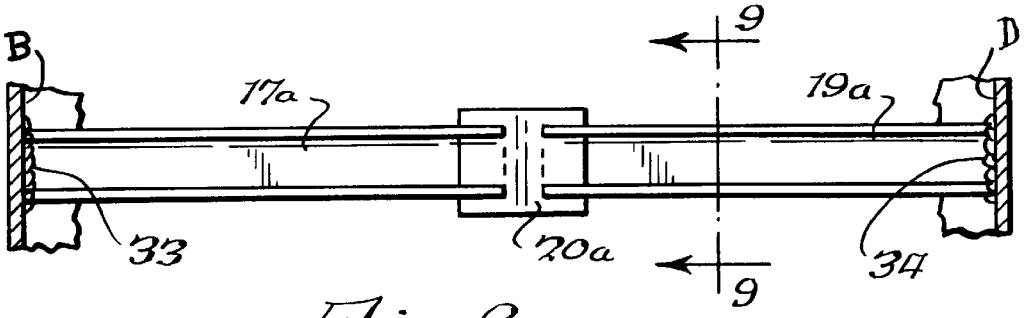
FIG. 8 is a fragmentary view, partially in cross section, taken substantially along line 8—8 of FIG. 7.
Figure 9:
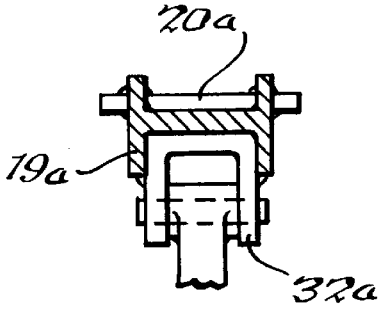
FIG. 9 is a fragmentary cross sectional view taken substantially along line 9—9 of FIG. 8.
Figure 10:
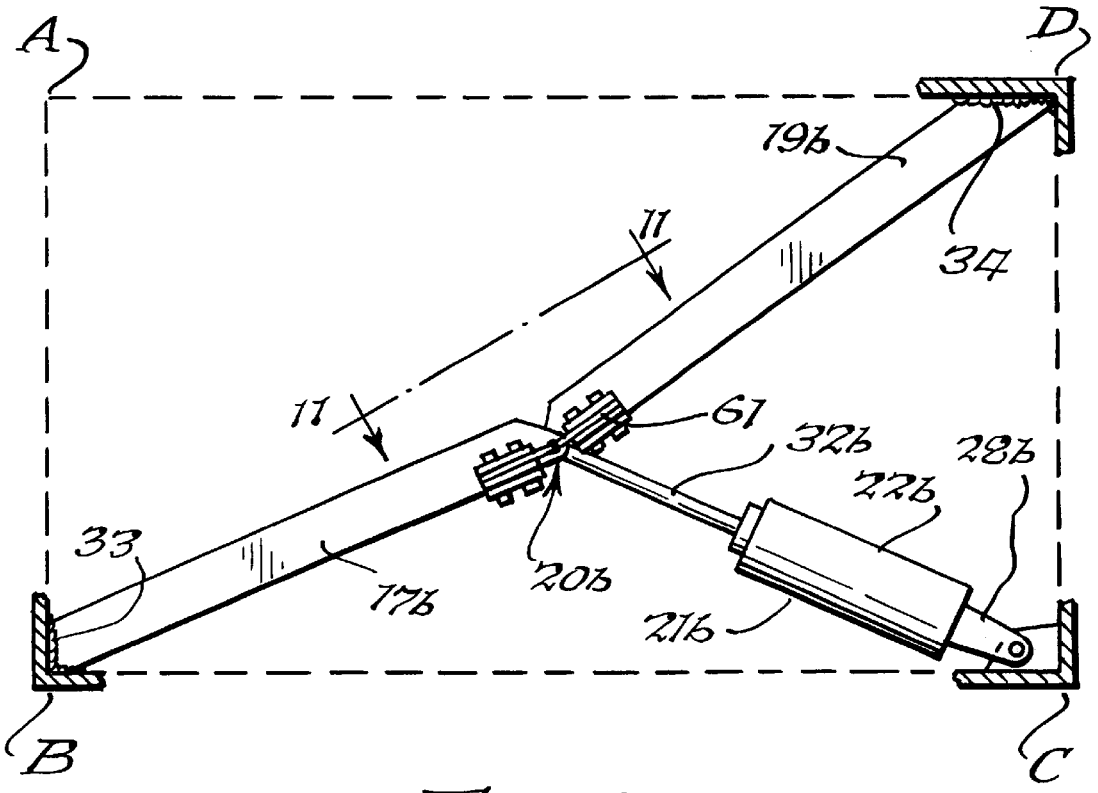
FIG. 10 is a side elevational view of an improved embodiment of the present invention wherein the pivotal axis of the piston rod coincides with the pivotal axis of the plate structure which couples the links.

In FIGS. 7–9 an alternate embodiment of an earlier form of the present invention is disclosed. The only differences between the embodiment of FIGS. 7–9 and that of FIGS. 4–6 are three-fold. Firstly, the links 17*a* and 19*a* are in the form of I-beams rather than the hollow cylindrical links 17 and 19. Secondly, the links 17*a* and 19*a* are placed in compression if shock absorber 22*a* in link 21*a* is a liquid spring. Thirdly, the outer ends of links 17*a* and 19*a* are of a configuration so that they can be welded directly to the frame of the building, that is, they do not have solid joints such as plates 25 and 27 of FIGS. 4–6 therebetween. However, as noted above, the shock absorber can be a liquid spring, or a damper of any type, or a combination of a liquid spring and damper. However, a liquid spring such as shown in U.S. Pat. No. 5,462,141, dated Oct. 31, 1995, is preferred, and the subject matter relating to FIGS. 2–7 of this patent is incorporated herein by reference.

In FIGS. 7–9 links 17*a* and 19*a* have their inner ends welded to plate 20*a* which is analogous to plate 20 of FIGS. 4–6. Also, in FIGS. 7–9 the outer ends of links 17*a* and 19*a* are welded directly to frame portions B and D at 33 and 34, respectively, whereas in FIGS. 4–6, solid movable joints in the form of metal plates 25 and 27 are used to produce slight angular movements. It will be appreciated that there can be the direct welding of the links 17*a* and 19*a* to the frame in certain instances because of the very slight angular movements in these areas. One end of link 21*a*, namely, the piston 32' of shock absorber 22*a*, is connected to link 19*a* at clevis joint 32*a* and the cylinder of the shock absorber 22*a* is connected to the building frame at C by clevis joint 28*a*.

While the solid joints have been shown above as comprising welded plates such as 20, 25, 27 and 20*a*, it will be appreciated that, if desired, these plates can be rigidly secured by bolts or rivets between the parts which they connect and these modifications will also comprise solid joints. Also, while clevis joints have been shown at the ends of links 21 and 21*a*, it will be appreciated that any other type of joints can be used for connecting links 21 and 21*a* between the other parts of the toggle linkage and the frame of the building.

Liquid springs of the type which can also be used are shown in U.S. Pat. Nos. 4,582,303 and 4,064,977, and dampers such as shown in U.S. Pat. Nos. 4,638,895, 4,815,574 and 4,867,286 may also be used, and other types of non-liquid shock absorbers may also be used, and such patents are incorporated herein by reference.

While the foregoing description has specifically described shock absorbers in the form of hydraulic energy absorbing devices, it will be appreciated that the toggle linkage is not limited thereto but may also be used with other types of energy absorbing devices including but not limited to viscoelastic rubber damping elements, such as shown in U.S. Pat. No. 4,910,929, hysteretic (friction) damping elements and yieldable steel damping elements, such as shown in U.S. Pat. No. 4,910,929, said patents being incorporated herein by reference.

In FIGS. 10–14 an embodiment of the present invention is disclosed wherein the link which contains the damper is connected to the other two links of the toggle linkage along an axis which is coincident with the bending axis of the solid joint between the latter two links. More specifically, in FIG. 10 a building frame ABCD is shown having a toggle linkage consisting of links 17*b*, 19*b* and 21*b*, the latter containing damper 22*b*. Links 17*b*, 19*b* and 21*b* may be identical to links 17*a*, 19*a* and 21*a*, respectively, of FIGS. 7 and 8 except for the manner in which they are interconnected at their junction. Otherwise, they are installed in frame ABCD in a manner which is identical to that disclosed in FIGS. 7 and 8. The only difference between the embodiment of FIGS. 7 and 8 and the embodiment of FIGS. 10–14 is in the specific construction of the solid joint 20*b* and the connection of link 21*b* to links 17*b* and 19*b*. All numerals in FIGS. 10–14 correspond to like numerals in FIGS. 7 and 8 regardless of the differences in suffixes. Also FIGS. 10–14 differ from FIGS. 7 and 8 in that members 17*b* and 19*b* are square tubular members, whereas links 17*a* and 19*a* are in the form of I-beams.

The piston rod 32*b* of link 21*b* is connected to links 17*b* and 19*b* in the following manner. An ear 40 having a bore 41 is formed integrally with link 19*b*, and an ear 42 having a bore 43 is formed integrally with link 17*b*. The end of piston rod 32*b* is formed into a hollow cylindrical member 44 having a bore 45 therein. A pin 47 extends through aligned bores 41, 43 and 45 to thereby secure piston rod 32*b* of link 21*b* and links 17*b* and 19*b* together about an axis 49 which is coincident with section line 13—13.

The solid joint 20*b* is formed in the following manner. A bracket 50 has a central portion 51 which underlies link 19*b* and has end portions 52 and 53, and it is welded to link 19*b*. A second bracket 50', which is identical in all respects to bracket 50, has a central portion 51' which underlies link 17*b*, and it has end portions 52' and 53' which correspond to end portions 52 and 53, respectively, of bracket 50. Bracket 50' is suitably welded to link 17*b*. A first thin metal plate 54 has its opposite ends positioned in contiguous overlying relationship to bracket ends 53 and 53' of brackets 50 and 50', respectively. Blocks 55 an 57 bear on the opposite ends of plate 54, and the tightened bolts 59 and 60 cause one end of plate 54 to be clamped between bracket end 53 and block 57 and the other end of plate 54 to be clamped between bracket end 53' and block 55. A second thin metal plate 61 has its opposite ends positioned in contiguous overlying relationship to bracket ends 52 and 52' of brackets 50 and 50', respectively. Blocks 62 and 63 bear on the opposite ends of plate 61, and tightened bolts 64 and 65 cause one end of plate 61 to be clamped between bracket end 52 and block 62 and the other end of plate 61 to be clamped between bracket end 52' and block 63. The thin metal plates 54 and 61 are made of high strength steel such as AISI types 4140 or 4340, and they impart relatively little spring forces into the structure when they bend. The exact thickness of the plates will depend on the estimated loads to which the plates are to be subjected. The steel plates 54 and 61 can be about one-half inch thick and about five inches wide when they carry a load up to about 50,000 pounds in compression.

Figure 11:
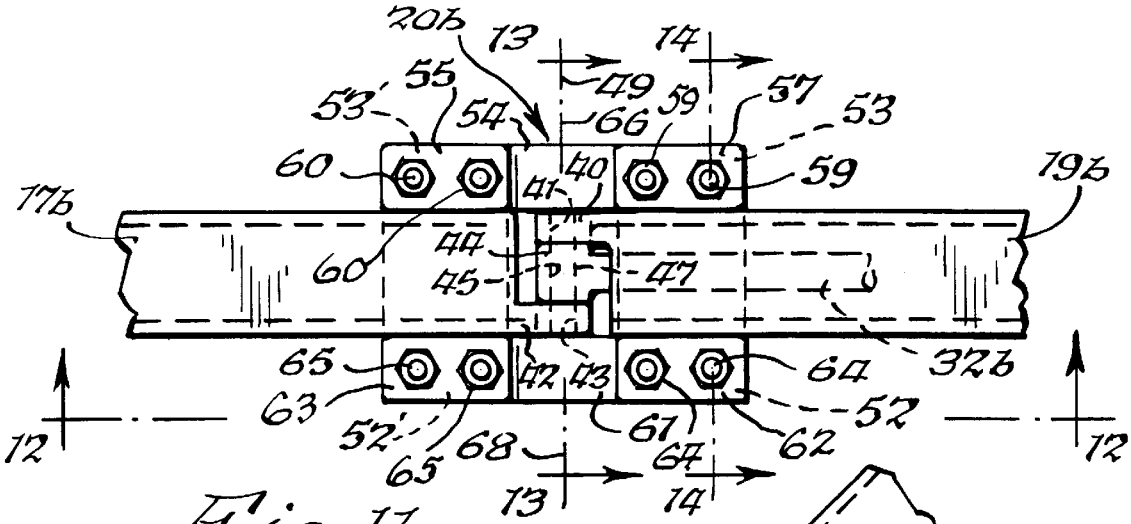
FIG. 11 is a fragmentary enlarged view taken substantially in the direction of arrows 11—11 of FIG. 10.
Figure 12:
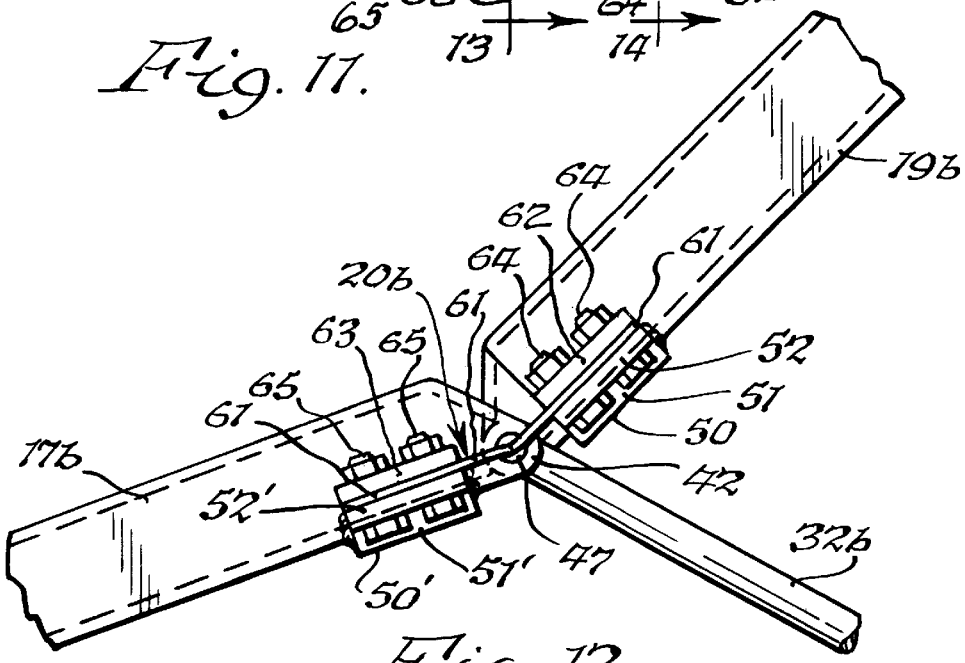
FIG. 12 is a fragmentary side elevational view taken substantially in the direction of arrows 12—12 of FIG. 11.
Figure 13:
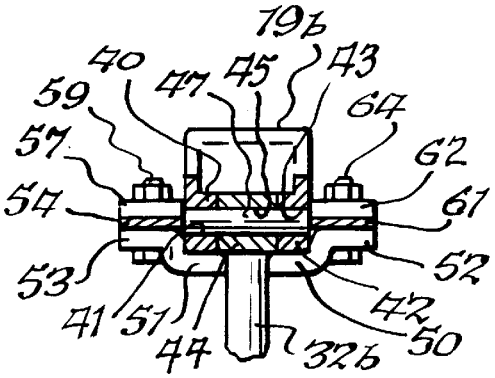
FIG. 13 is a fragmentary cross sectional view taken substantially along line 13—13 of FIG. 11 and showing in detail how the pivotal axes of the plates and the outer end of the piston rod coincide.
Figure 14:
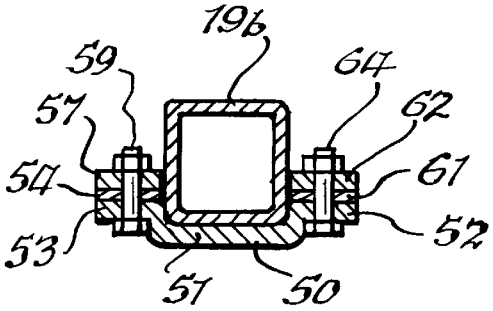
FIG. 14 is a cross sectional view taken substantially along line 14—14 of FIG. 11 and showing the connections between the plates and the links.

From FIG. 11 it can be seen that the axis of pin 47 is coincident with the bending axes 66 and 68 of plates 54 and 61, respectively. In other words, the bending axes of plates 54 and 61, and the axis of pin 47 all lie along the centerline 49.

It can thus be seen that the piston rod 32*b* is connected substantially equally to each of links 17*b* and 19*b* and thus the distribution of force from damper 22*b* is applied equally to these links. Furthermore, the bending axes 66 and 68 of plates 54 and 61, respectively, are coincident with the pivot axis 49 between links 17*b* and 19*b*. It is further noted that the solid joint between links 17*b* and 19*b* consists of two separate plates 54 and 61 whereas the solid joint shown in FIGS. 1–9 consisted of a single plate.

In view of the foregoing construction shown in FIGS. 10–14, the movement between links 17*b* and 19*b* will be transmitted accurately to link 22*b* because there is no undulation in the solid joint consisting of plates 54 and 61, and this results from the fact, as noted above, that the force of the damper 22*b* is applied equally to links 17*b* and 19*b*.

While a specific form of connection of plates 54 and 61 to links 17*b* and 19*b* has been shown, it will be appreciated that the plates 54 and 60 can be connected to the links in any other suitable manner. Also, the positions of plates 54 and 61 need not be as shown but may lie along the centerlines of link 17*b* and 19*b* or in any other position.

While the solid joints between the frame and links 17*b* and 19*b* is shown as welds, it will be appreciated that they may be in the form of plates as shown in FIGS. 4 and 5, and such plates may be bolted or riveted between the frame and the links. Also, it will be appreciated that any of the features shown and described relative to FIGS. 1–9 may be incorporated into the embodiment of FIGS. 10–14 provided that they are not inconsistent therewith.

While preferred embodiments of the present invention have been disclosed, it is will be appreciated that it is not limited thereto but may be otherwise embodied within the scope of the following claims.

I claim:

1. A seismic isolator for placement in a frame of a structure comprising a first link having a shock absorbing member therein, a first end on said first link for connection to a first area on said frame, a second end on said first link, a second link having a first end for connection to a second area on said frame remote from said first area, a second end on said second link, a third link having a first end for connection to a third area on said frame remote from said first and second areas, a second end on said third link, means providing a solid joint connecting said second ends of said second and third links to each other, a bending axis on said means providing a solid joint, and a connection between said second end of said first link and said second and third links which is substantially coincident with said bending axis.

2. A seismic isolator as set forth in claim 1 wherein said connection between said second end of said first link and said second and third links is a pivotable connection.

3. A seismic isolator as set forth in claim 1 wherein said first ends of said second and third links are of a configuration for welding to said frame.

4. A seismic isolator as set forth in claim 1 including means providing a second solid joint at said first end of said second link.

5. A seismic isolator as set forth in claim 4 including means providing a third solid joint at said first end of said third link.

6. A seismic isolator as set forth in claim 1 wherein said second and third links are in tension.

7. A seismic isolator as set forth in claim 1 wherein said shock absorbing member is a liquid spring.

8. A seismic isolator as set forth in claim 1 wherein said shock absorbing member is a liquid damper.

9. A seismic isolator as set forth in claim 1 wherein said shock absorbing member is a combined liquid spring and damper.

10. A seismic isolator as set forth in claim 1 wherein said second and third links have longitudinal axes which lie in a plane when said second and third links are not activated by a seismic event, and wherein said second ends of said second and third links are spaced from each other, and wherein said means providing a solid joint comprises a metal plate structure rigidly secured to said second ends of said second and third links, said metal plate structure having a width dimension which extends transversely to said plane and a thickness dimension which extends in substantially the same direction as said plane, and said metal plate structure being so oriented relative to said second and third links so as to flex only in a direction substantially of its thickness dimension while said metal plate structure does not flex in the direction of its width dimension to thereby cause said longitudinal axes to remain in said plane when said second and third links are activated by a seismic event.

11. A seismic isolator as set forth in claim 10 wherein said metal plate structure comprises metal plates on opposite sides of said second and third links.

12. A seismic isolator as set forth in claim 10 wherein said connection between said second end of said first link and said second and third links is a pivotable connection.

13. A seismic isolator as set forth in claim 10 wherein said first ends of second and third links are of a configuration for welding to said frame.

14. A seismic isolator as set forth in claim 10 including means providing a second solid joint at said first end of said second link.

15. A seismic isolator as set forth in claim 10 including means providing a third solid joint at said first end of said third link.

16. A seismic isolator as set forth in claim 10 wherein said second and third links are in tension.

17. A seismic isolator as set forth in claim 10 wherein said shock absorbing member is a liquid spring.

18. A seismic isolator as set forth in claim 10 wherein said shock absorbing member is a liquid damper.

19. A seismic isolator as set forth in claim 10 wherein said shock absorbing member is a combined liquid spring and damper.

20. In a structure having a frame consisting of a plurality of frame members connected in a polygonal configuration, a seismic isolator comprising a first link having a shock absorbing member therein, a first end on said first link connected to said frame at a first area, a second end on said first link, a second link having a first end connected to said frame at a second area which is remote from said first area, a second end on said second link, a third link having a first end connected to said frame at a third area which is remote from said first and second areas, a second end on said third link, means providing a solid joint connecting said second ends of said second and third links, a bending axis on said means providing a solid joint, and said second end of said first link being connected to said second and third links along an axis which is substantially coincident with said bending axis.

21. In a structure as set forth in claim 20 wherein said second end of said first link is pivotally connected to said second and third links.

22. In a structure as set forth in claim 20 wherein said first ends of said second and third links are welded to said frame.

23. In a structure as set forth in claim 20 wherein said second and third links are in tension.

24. In a structure as set forth in claim 20 wherein said shock absorbing member is a liquid spring.

25. In a structure as set forth in claim 20 wherein said shock absorbing member is a fluid damper.

26. In a structure as set forth in claim 20 wherein said shock absorbing member is a combined liquid spring and damper.

27. In a structure as set forth in claim 20 wherein said first end of said second link is connected to said frame by means providing a second solid joint between said first end of said second link and said frame.

28. In a structure as set forth in claim 27 wherein said means providing a second solid joint comprises a plate welded between said first end of said second link and said frame.

29. In a structure as set forth in claim 27 wherein said first end of said third link is connected to said frame by means providing a third solid joint between said first end of said third link and said frame.

* * * * *